US009614321B2

(12) United States Patent
Nakamura et al.

(10) Patent No.: US 9,614,321 B2
(45) Date of Patent: Apr. 4, 2017

(54) MAGNETIC CONNECTOR

(71) Applicant: Japan Aviation Electronics Industry, Limited, Tokyo (JP)

(72) Inventors: Keisuke Nakamura, Tokyo (JP); Hiroshi Akimoto, Tokyo (JP); Seiya Takahashi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 57 days.

(21) Appl. No.: 14/615,323

(22) Filed: Feb. 5, 2015

(65) Prior Publication Data

US 2015/0255918 A1 Sep. 10, 2015

(30) Foreign Application Priority Data

Mar. 7, 2014 (JP) ..... 2014-045215

(51) Int. Cl.
*H01R 13/60* (2006.01)
*H01R 13/62* (2006.01)
*H01R 12/77* (2011.01)

(52) U.S. Cl.
CPC ..... *H01R 13/6205* (2013.01); *H01R 12/77* (2013.01)

(58) Field of Classification Search
CPC ..... H01R 13/6205; H01R 11/30; H01R 13/24
USPC ..... 439/38–3, 749
See application file for complete search history.

(56) References Cited

U.S. PATENT DOCUMENTS 5,395,250 A * 3/1995 Englert, Jr. ..... H01R 12/716 439/65
7,914,293 B2 * 3/2011 Koguchi ..... H01R 12/714 439/65
9,300,081 B2 * 3/2016 Rudisill ..... H01R 13/6205
2009/0163054 A1 6/2009 Koguchi
2013/0273752 A1 10/2013 Rudisill

FOREIGN PATENT DOCUMENTS

CN 101465484 A 6/2009
JP 05-135833 A 6/1993

* cited by examiner

*Primary Examiner* — Xuong Chung Trans
(74) *Attorney, Agent, or Firm* — Muncy, Geissler, Olds & Lowe, P.C.

(57) ABSTRACT

A magnetic connector has a connector body including a magnet, a plurality of connection terminals that are arranged and fixed on the connector body so as to correspond to a plurality of contact patterns of a connection object, and a plurality of attracted members that are formed of magnetic substance, are arranged and fixed on a support member having a sheet-like shape and flexibility so as to correspond to the plurality of contact patterns of the connection object and are, via the connection object on which the plurality of contact patterns are arranged to face the plurality of connection terminals, attracted toward the connector body due to magnetic force whereby the plurality of contact patterns are pressed against the plurality of connection terminals and thereby connected to the plurality of connection terminals.

13 Claims, 19 Drawing Sheets

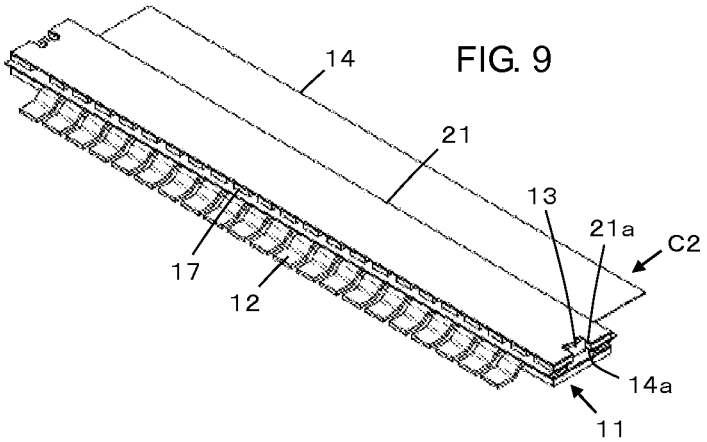
FIG. 9
FIG. 10
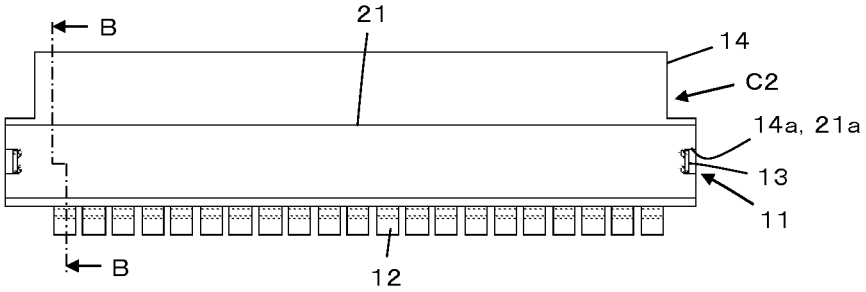
FIG. 11
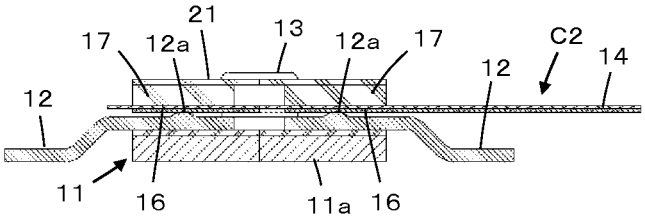

MAGNETIC CONNECTOR

CROSS-REFERENCE TO RELATED APPLICATIONS

The present application claims priority under 35 U.S.C. §119 to Japanese Patent Application No. 2014-45215, filed on Mar. 7, 2014. The above application is hereby expressly incorporated by reference, in its entirety, into the present application.

BACKGROUND OF THE INVENTION

The present invention relates to a magnetic connector, particularly to a magnetic connector for use in establishing the connection a connection object, such as a flexible printed circuit (FPC) and a flexible flat cable (FFC), in which a plurality of contact patterns are arranged on a base member having flexibility (property allowing flexible deflection).

In recent years, with the trend toward smaller sizes and higher densities of electronic devices, connectors for use in establishing the connection of connection objects such as FPCs and FFCs are also required to have reduced external dimensions. In this regard, a magnetic connector using a magnet is known as a connector capable of producing contact pressure at a contact without use of a spring contact, a cam mechanism or the like.

For instance, JP 5-135833 A discloses a magnetic connector in which two FPCs 2*a* and 2*b* are disposed to face to each other between openable and closable segment members 1*a* and 1*b* of a casing 1 as shown in FIG. 50. In the segment member 1*a*, a magnet plate 3 is embedded and fixed and a plurality of metal pieces 5*a* corresponding to patterns of contacts 4*a* of the FPC 2*a* are inserted and fixed between the magnet plate 3 and the FPC 2*a*, while in the segment member 1*b*, a plurality of metal pieces 5*b* corresponding to patterns of contacts 4*b* of the FPC 2*b* are held to be vertically movable within the segment member 1*b*.

Although the metal pieces 5*a* disposed above the FPC 2*a* are fixed on the segment member 1*a*, owing to the magnetic force from the magnet plate 3 that acts on the metal pieces 5*b* disposed under the FPC 2*b*, the metal pieces 5*b* movably held in the segment member 1*b* are attracted up toward the FPC 2*b* and this causes the contacts 4*b* of the FPC 2*b* to be pressed against the corresponding contacts 4*a* of the FPC 2*a*.

As a result, the contacts 4*a* of the FPC 2*a* and the contacts 4*b* of the FPC 2*b* are brought in contact with each other, thus securing connection reliability.

However, the magnetic connector of JP 5-135833 A needs to hold the metal pieces 5*b* corresponding to the patterns of the contacts 4*b* of the FPC 2*b* to be vertically movable in the segment member 1*b*, which results in complex structure and hampers the reduction in size.

SUMMARY OF THE INVENTION

The present invention has been made to overcome the above problem associated with the prior art and provide a magnetic connector capable of establishing highly reliable connection with simple and compact structure.

A magnetic connector according to the present invention comprises a connector body including a magnet, a plurality of connection terminals that are arranged and fixed on the connector body so as to correspond to a plurality of contact patterns of the connection object, and a plurality of attracted members that are formed of magnetic substance, are arranged and fixed on a support member having a sheet-like shape and flexibility so as to correspond to the plurality of contact patterns of the connection object and are, via the connection object on which the plurality of contact patterns are arranged to face the plurality of connection terminals, attracted toward the connector body due to magnetic force whereby the plurality of contact patterns are pressed against the plurality of connection terminals and thereby connected to the plurality of connection terminals.

BRIEF DESCRIPTION OF THE DRAWINGS

FIG. 9 is a perspective view showing the magnetic connector of Embodiment 2 in fitting state.

FIG. 10 is a plan view showing the magnetic connector of Embodiment 2 in fitting state.

FIG. 11 is a cross-sectional view taken along line B-B of FIG. 10.

DETAILED DESCRIPTION OF THE INVENTION

Embodiment 1

Hereinafter, Embodiment 1 of the present invention will be described based on accompanying drawings.

Figure 1:
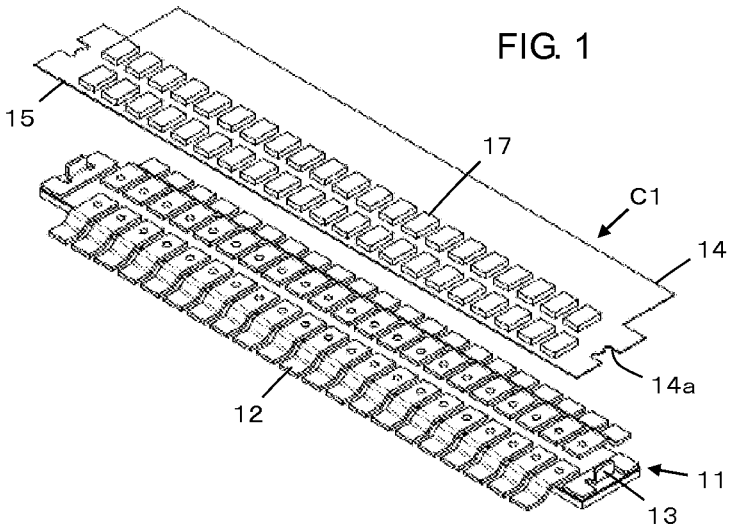
FIG. 1 is a perspective view showing a magnetic connector according to Embodiment 1 of the present invention when viewed obliquely from above.
Figure 2:
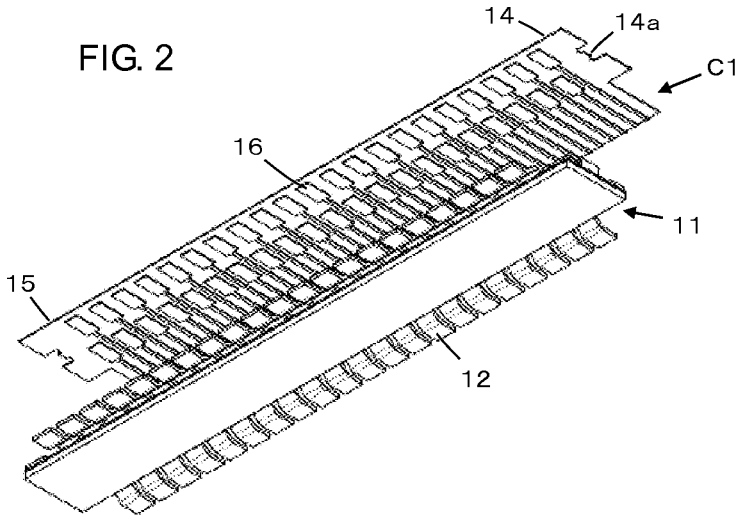
FIG. 2 is a perspective view showing the magnetic connector according to Embodiment 1 when viewed obliquely from the bottom.

FIGS. 1 and 2 show the structure of a magnetic connector according to Embodiment 1. The magnetic connector is for use in establishing the connection of a connection object C1 composed of a flexible printed circuit (FPC) and includes a connector body 11 of flat plate shape having a surface on which a plurality of connection terminals 12 are arranged and fixed in two lines.

Positioning parts 13 each composed of a projection and used for positioning the connection object C1 are formed on the surface of the connector body 11 separately at opposite end portions in the arrangement direction of the connection terminals 12.

The connection object C1 includes a base member 14 having a sheet-like shape and flexibility. The base member 14 is made of, for instance, polyimide. A plurality of contact patterns 16 are arranged in two lines on the bottom surface of the base member 14 along a connection end 15 of the connection object C1. The connection terminals 12 fixed on the surface of the connector body 11 are arranged to correspond to the contact patterns 16 of the connection object C1 on a one-to-one basis.

A plurality of attracted members 17 formed of magnetic substance (ferromagnetic substance) are fixed on the top surface of the base member 14 so as to correspond to the contact patterns 16 on a one-to-one basis and to be located immediately above the corresponding contact patterns 16 on the opposite side of the base member 14 from the contact patterns 16. Since the connection terminals 12 correspond to the contact patterns 16 on a one-to-one basis and the absorbent members 17 correspond to the contact patterns 16 on a one-to-one basis, the connection terminals 12 also correspond to the attracted members 17 on a one-to-one basis accordingly.

The attracted members 17 each composed of, for example, a piece of metal such as iron and nickel are able to be joined to the base member 14 by thermocompression (i.e., the attracted members 17 are applied with pressure and pressed closely against the base member 14 under heat) or be adhered to the base member 14 with an adhesive.

Positioning notches 14*a* of U-shape are separately formed at edges of the base member 14 at opposite end portions in the arrangement direction of the contact patterns 16. The positioning notches 14*a* have a size corresponding to the positioning parts 13 formed on the surface of the connector body 11.

Figure 3:
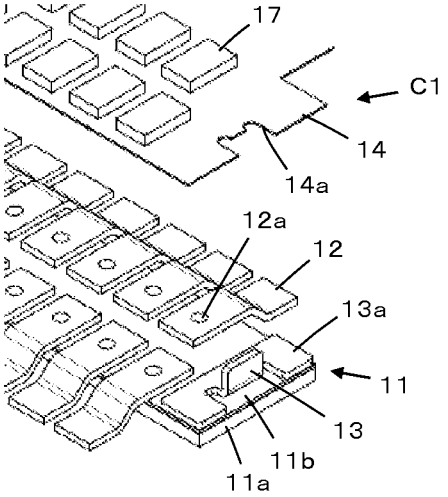
FIG. 3 is an enlarged perspective view partially showing the magnetic connector according to Embodiment 1.

As shown in FIG. 3, the connector body 11 is composed of a magnet 11*a* of flat plate shape and an insulation sheet 11*b* stuck to a surface of the magnet 11*a*. The connection terminals 12 are fixed on the insulation sheet 11*b*. A polyimide sheet is applicable as the insulation sheet 11*b*, for example. When the magnet 11*a* is non-conductive, the connection terminals 12 may be fixed directly on the magnet 11*a* without the insulation sheet 11*b*.

Contact portions 12*a* are formed to project from surfaces of the connection terminals 12.

The positioning parts 13 at the ends of the connector body 11 are each composed of a projection obtained by bending a part of a metal member 13*a* fixed on the surface of the connector body 11.

Figure 4:
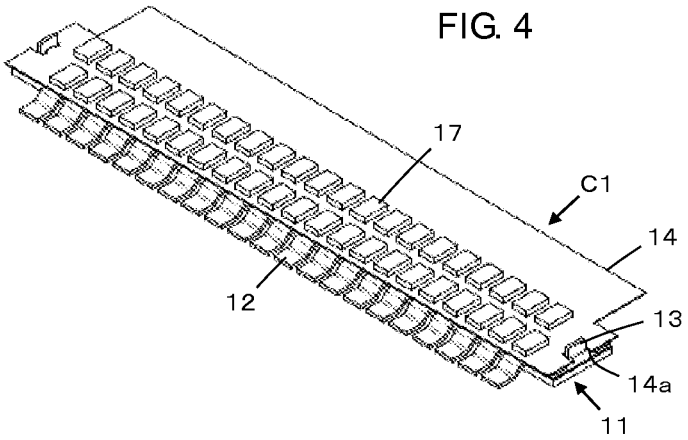
FIG. 4 is a perspective view showing the magnetic connector of Embodiment 1 in fitting state.
Figure 5:
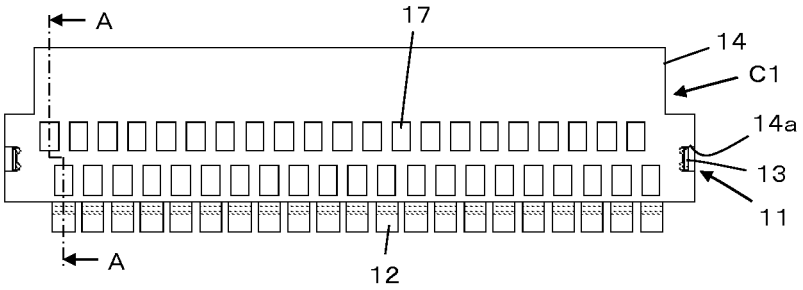
FIG. 5 is a plan view showing the magnetic connector of Embodiment 1 in fitting state.

Next, fitting operation of the magnet connector according to Embodiment 1 is described below. As shown in FIGS. 4 and 5, the connection object C1 can be fitted to the connector body 11 simply by positioning the connection object C1 over the connector body 11 as engaging a pair of the positioning notches 14*a* formed at the base member 14 of the connection object C1 with the corresponding positioning parts 13 of the connector body 11.

Figure 6:
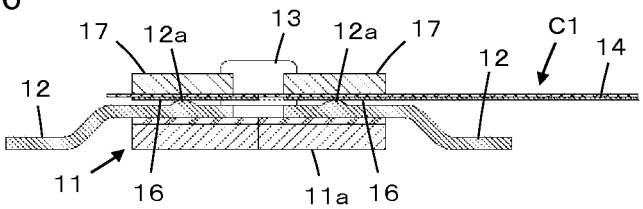
FIG. 6 is a cross-sectional view taken along line A-A of FIG. 5.

Insertion of the positioning parts 13 of the connector body 11 into the positioning notches 14*a* of the connection object C1 enables the connection object C1 to be properly positioned with respect to the connector body 11 so that the contact patterns 16 formed on the bottom surface of the base member 14 of the connection object C1 are respectively positioned on surfaces of the contact portions 12*a* of the corresponding connection terminals 12 of the connector body 11 as shown in FIG. 6. Since the attracted members 17 are fixed on the top surface of the base member 14 of the connection object C1 to be located immediately above the contact patterns 16, in the foregoing state, the contact portions 12*a* of the connection terminals 12, the corresponding contact patterns 16 and the corresponding attracted members 17 vertically overlap each other via the base member 14.

The magnetic force from the magnet 11*a* of the connector body 11 acts on the attracted members 17 formed of magnetic substance, so that the respective attracted members 17 are attracted toward the connector body 11, and the contact patterns 16 of the connection object C1 located immediately below the corresponding attracted members 17 are pressed against the contact portions 12*a* of the corresponding connection terminals 12. Since the base member 14 of the connection object C1 is formed of a flexible material, the attracted members 17 are individually attracted to the connector body 11, and the contact patterns 16 are individually pressed against the contact portions 12*a* of the corresponding connection terminals 12.

Uniform contact pressure is therefore ensured between the connection terminals 12 fixed on the connector body 11 and the contact patterns 16 formed on the connection object C1, thus improving connection reliability.

As described above, according to Embodiment 1, the attracted members 17 are fixed on the top surface of the base member 14 so as to correspond to the contact patterns 16 arranged on the bottom surface of the base member 14 of the connection object C1 having flexibility, and the connection terminals 12 are fixed on the surface of the connector body 11 including the magnet 11*a*. This configuration enables highly reliable connection to be established with simple and compact structure.

While the contact patterns 16 are arranged in two lines on the bottom surface of the base member 14 of the connection object C1 and the connection terminals 12 are arranged in two lines on the surface of the connector body 11, the arrangement is not limited thereto as long as the connection terminals 12 are formed on the surface of the connector body 11 so as to correspond to the contact patterns 16 on the connection object C1.

Embodiment 2

Figure 7:
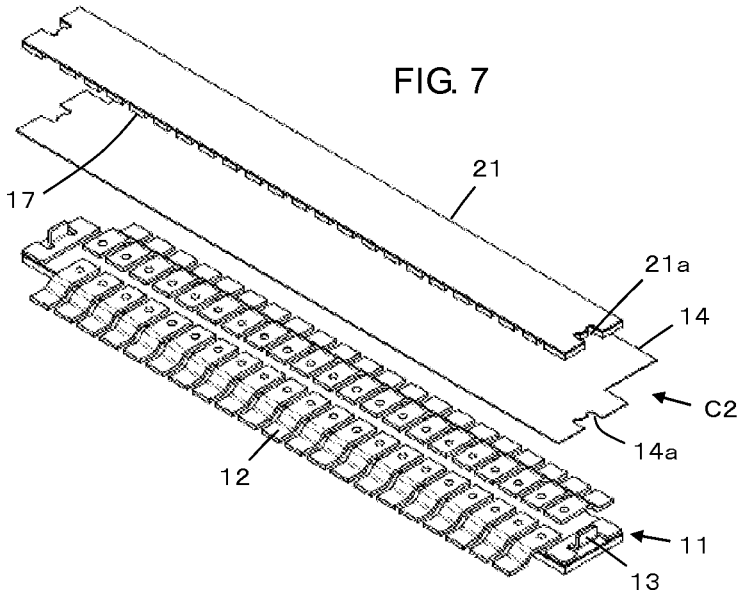
FIG. 7 is a perspective view showing a magnetic connector according to Embodiment 2 when viewed obliquely from above.
Figure 8:
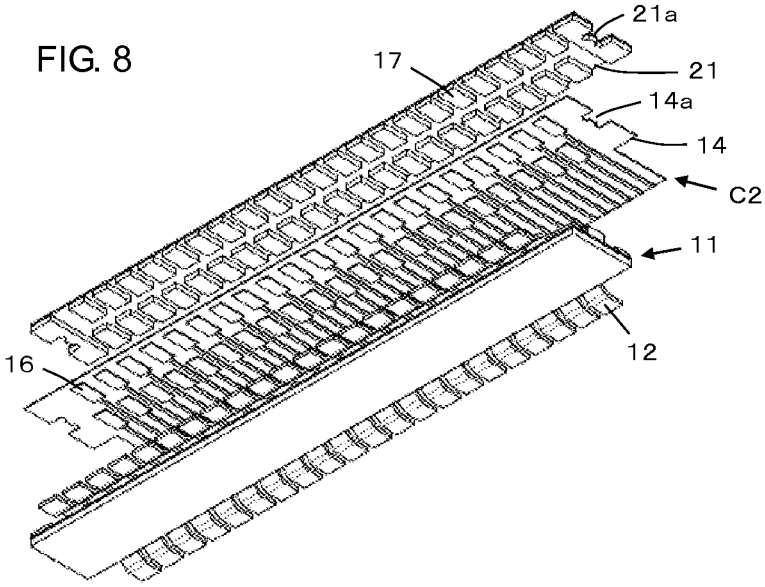
FIG. 8 is a perspective view showing the magnetic connector according to Embodiment 2 when viewed obliquely from the bottom.

FIGS. 7 and 8 show the structure of a magnetic connector according to Embodiment 2. In this magnetic connector, instead of the connection object C1 in which the attracted members 17 are fixed on the top surface of the base member 14 in the magnetic connector of Embodiment 1 shown in FIGS. 1 and 2, a connection object C2 having no attracted member 17 is used; a support member 21 having a sheet-like shape and flexibility is provided independently of the connection object C2 and the connector body 11; and the attracted members 17 are fixed on the bottom surface of the support member 21. The connection terminals 12 are connected to the contact patterns 16 by disposing the support member 21 on the connection object C2.

The connector body 11 and the connection terminals 12 are the same as those used in Embodiment 1, and the positioning parts 13 are formed on the surface of the connector body 11 separately at opposite end portions in the arrangement direction of the connection terminals 12. The connection object C2 has the same base member 14 as in the connection object C1 used in Embodiment 1. The contact patterns 16 are formed on the bottom surface of the base member 14, and the positioning notches 14*a* are separately formed at edges of the base member 14 at opposite end portions in the arrangement direction of the contact patterns 16.

The support member 21 is made of, for instance, polyimide. The attracted members 17 are arranged and fixed on the bottom surface of the support member 21 so as to correspond to the contact patterns 16 of the connection object C2. Positioning notches 21*a* of U-shape are formed at the support member 21 separately at opposite end portions in the arrangement direction of the attracted members 17. The positioning notches 21*a* have a size corresponding to the positioning parts 13 of the connector body 11 in the same manner as the positioning notches 14*a* at the base member 14 of the connection object C2.

Next, fitting operation of the magnet connector according to Embodiment 2 is described below. As shown in FIGS. 9 and 10, the connection object C2 can be fitted to the connector body 11 simply by positioning the connection object C2 over the connector body 11 as engaging a pair of the positioning notches 14*a* formed at the base member 14 of the connection object C2 with the corresponding positioning parts 13 of the connector body 11 and also by positioning the support member 21 over the connection object C2 so that the surface having the attracted members 17 fixed thereto faces the connection object C2 as engaging a pair of the positioning notches 21*a* formed at the support member 21 with the corresponding positioning parts 13 of the connector body 11.

Insertion of the positioning parts 13 of the connector body 11 into the positioning notches 14*a* of the connection object C2 and the positioning notches 21*a* of the support member 21 enables the connection object C2 and the support member 21 to be properly positioned with respect to the connector body 11. As a result, the contact portions 12*a* of the connection terminals 12 and the corresponding contact patterns 16 of the connection object C2 vertically overlap each other, and the attracted members 17 fixed on the support member 21 are positioned to vertically overlap the contact portions 12*a* of the corresponding connection terminals 12 and the corresponding contact patterns 16 of the connection object C2 via the base member 14 of the connection object C2, as shown in FIG. 11.

The magnetic force from the magnet 11*a* of the connector body 11 acts on the attracted members 17 formed of magnetic substance, so that the respective attracted members 17 are attracted toward the connector body 11, and the contact patterns 16 of the connection object C2 located immediately below the corresponding attracted members 17 are pressed against the contact portions 12*a* of the corresponding connection terminals 12. Since the support member 21 and the base member 14 of the connection object C2 are formed of a flexible material, the attracted members 17 are individually attracted to the connector body 11, and the contact patterns 16 are individually pressed against the contact portions 12*a* of the corresponding connection terminals 12.

Uniform contact pressure is therefore ensured between the connection terminals 12 and the contact patterns 16 of the connection object C2, thus achieving highly reliable connection similarly to the magnetic connector of Embodiment 1.

Figure 12:
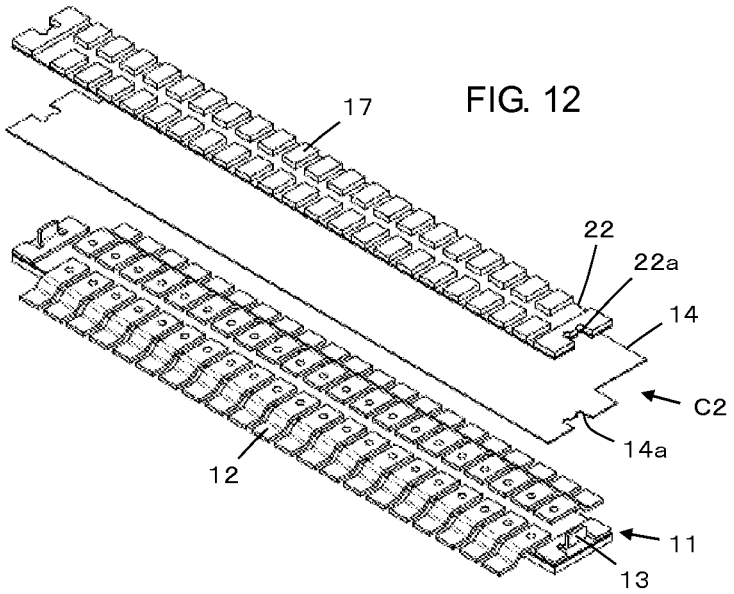
FIG. 12 is a perspective view showing a magnetic connector according to a modification of Embodiment 2 when viewed obliquely from above.
Figure 13:
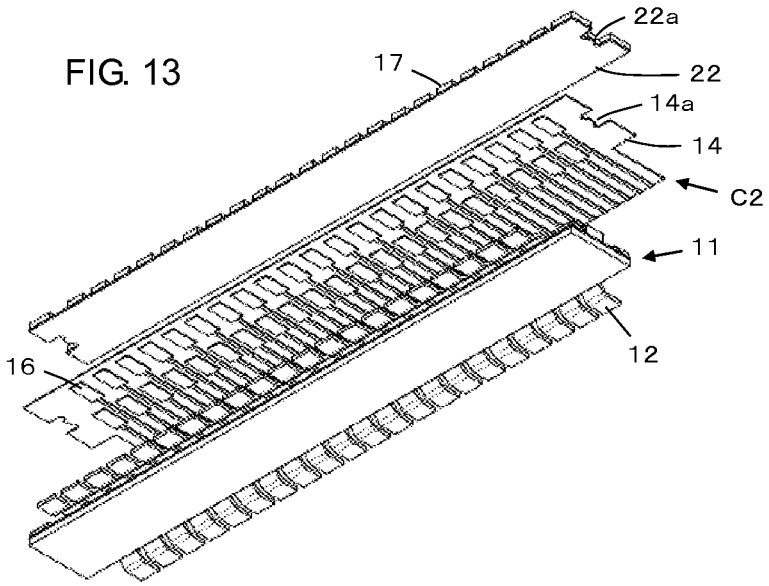
FIG. 13 is a perspective view showing the magnetic connector according to the modification of Embodiment 2 when viewed obliquely from the bottom.

While in Embodiment 2 described above, the support member 21 is positioned on the connection object C2 with the attracted members 17 fixed on the bottom surface of the support member 21 facing the connection object C2, a support member 22 may be positioned on the connection object C2 with the attracted members 17 being arranged and fixed on the top surface of the support member 22 at positions corresponding to the contact patterns 16 of the connection object C2 so that the attracted members 17 face the opposite direction from the connection object C2 as shown in FIGS. 12 and 13.

The support member 22 is a sheet-like member having flexibility as with the support member 21 and made of, for instance, polyimide.

Figure 14:
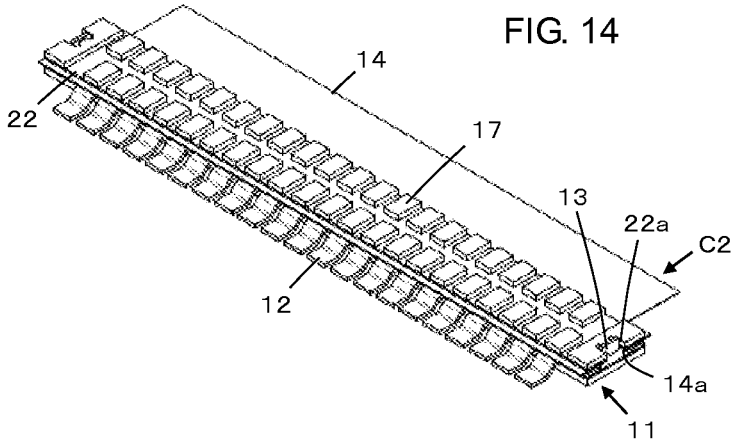
FIG. 14 is a perspective view showing the magnetic connector of the modification of Embodiment 2 in fitting state.
Figure 15:
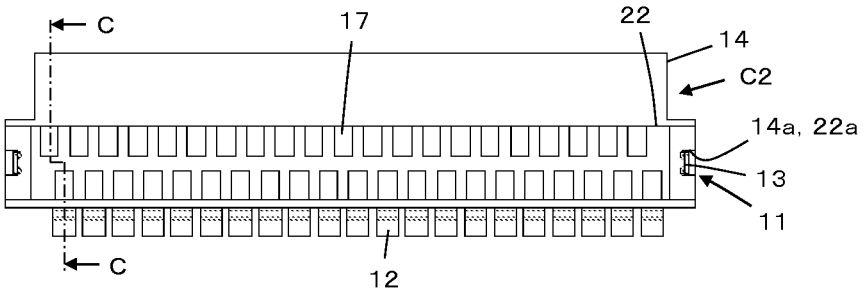
FIG. 15 is a plan view showing the magnetic connector of the modification of Embodiment 2 in fitting state.

As shown in FIGS. 14 and 15, the connection object C2 can be fitted to the connector body 11 simply by positioning the connection object C2 over the connector body 11 as engaging a pair of the positioning notches 14*a* formed at the base member 14 of the connection object C2 with the corresponding positioning parts 13 of the connector body 11 and also by positioning the support member 22 over the connection object C2 so that the surface having the attracted members 17 fixed thereon faces upward, i.e., the opposite direction from the connection object C2 as engaging a pair of positioning notches 22*a* formed at the support member 22 with the corresponding positioning parts 13 of the connector body 11.

Figure 16:
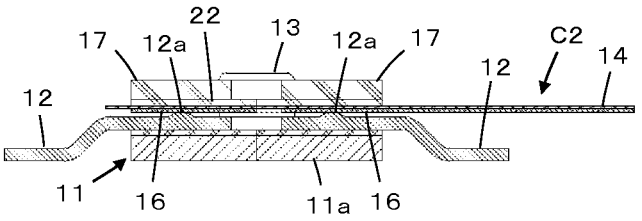
FIG. 16 is a cross-sectional view taken along line C-C of FIG. 15.

Insertion of the positioning parts 13 of the connector body 11 into the positioning notches 14*a* of the connection object C2 and the positioning notches 22*a* of the support member 22 enables the connection object C2 and the support member 22 to be properly positioned with respect to the connector body 11. As a result, the contact portions 12*a* of the connection terminals 12 and the corresponding contact patterns 16 of the connection object C2 vertically overlap each other, and the attracted members 17 fixed on the support member 22 are positioned to vertically overlap the contact portions 12*a* of the corresponding connection terminals 12 and the corresponding contact patterns 16 of the connection object C2 via the base member 14 of the connection object C2 and the support member 22 as shown in FIG. 16.

Also with such a configuration, the magnetic force from the magnet 11*a* of the connector body 11 acts on the attracted members 17 formed of magnetic substance, so that the respective attracted members 17 are attracted toward the connector body 11, and the contact patterns 16 of the connection object C2 located immediately below the corresponding attracted members 17 are pressed against the contact portions 12*a* of the corresponding connection terminals 12. Uniform contact pressure is therefore ensured between the connection terminals 12 and the contact patterns 16 of the connection object C2, thus achieving highly reliable connection.

In Embodiment 2, the attracted members 17 are fixed on the surface of the support member 21 or 22 having a sheet-like shape and flexibility that is independent of the connection object C2 and the connector body 11, and the support member 21 or 22 is disposed on the connection object C2 for use. This configuration allows the connection of the connection object C2 that already exists to be achieved without the process of fixing the attracted members 17 to the connection object C2.

Embodiment 3

Figure 17:
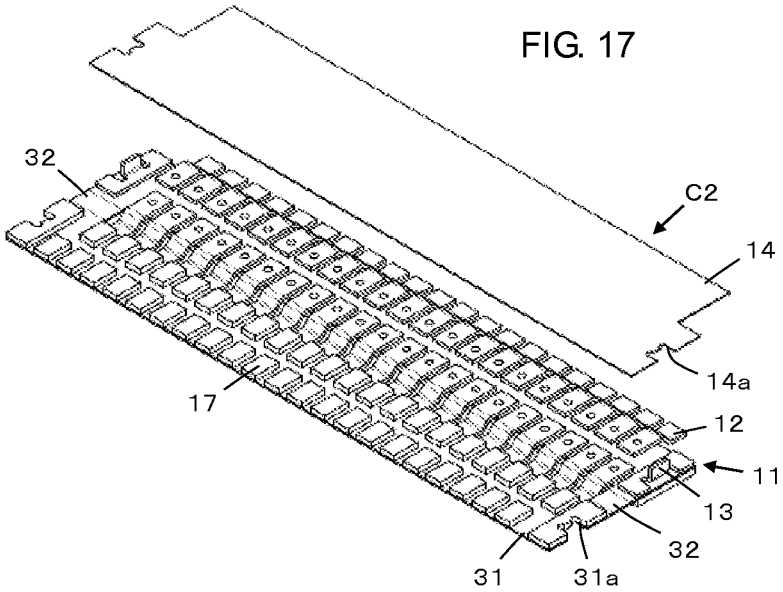
FIG. 17 is a perspective view showing a magnetic connector according to Embodiment 3 when viewed obliquely from above.
Figure 18:
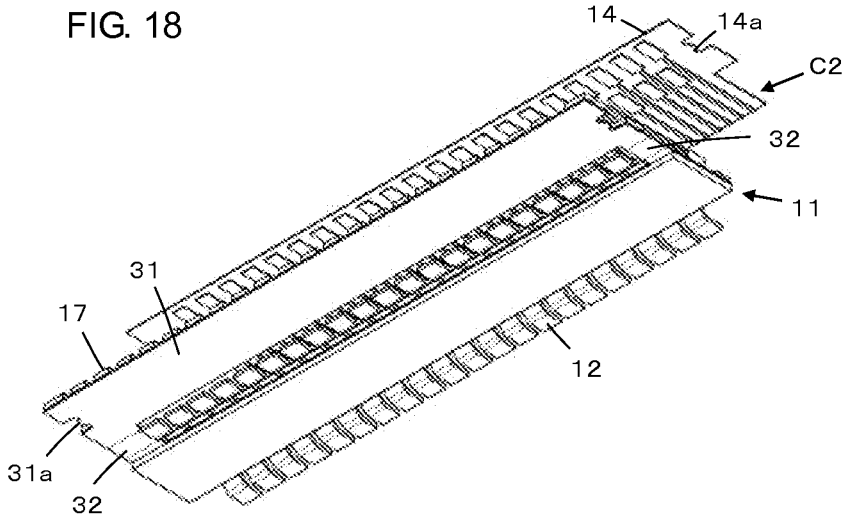
FIG. 18 is a perspective view showing the magnetic connector according to Embodiment 3 when viewed obliquely from the bottom.

FIGS. 17 and 18 show the structure of a magnetic connector according to Embodiment 3. In this magnetic connector, instead of using the support member 21 independent of the connection object C2 and the connector body 11 as in the magnetic connector of Embodiment 2 shown in FIGS. 7 and 8, the attracted members 17 are arranged and fixed on a surface of a support member 31 that is connected to the connector body 11 to be openable and closable.

Figure 19:
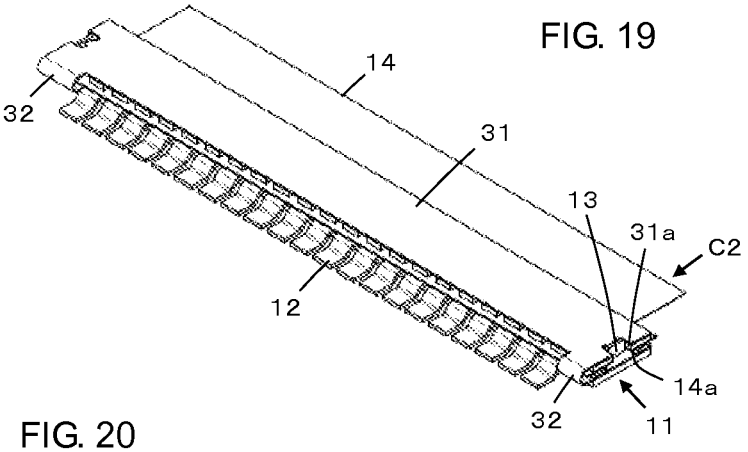
FIG. 19 is a perspective view showing the magnetic connector of Embodiment 3 in fitting state.

The support member 31 is a sheet-like member having flexibility, is made of, for instance, polyimide and is connected to the connector body 11 via a pair of connecting parts 32 at opposite end portions in the arrangement direction of the attracted members 17. The connecting parts 32 are also flexible members made of, for instance, polyimide as with the support member 31. The support member 31 is connected to the connector body 11 to be movable between the open position where the support member 31 is positioned laterally to the connector body 11 of flat plate shape to lie in the substantially same plane as the connector body 11 as shown in FIGS. 17 and 18 and the close position where the support member 31 overlaps the connector body 11 as shown in FIG. 19.

The attracted members 17 are arranged on the surface of the support member 31 so as to come to the positions corresponding to the contact patterns 16 of the connection object C2 and the connection terminals 12 on the connector body 11 when the close position is established in which the support member 31 overlaps the connector body 11.

Positioning notches 31*a* of U-shape are formed at the support member 31 separately at opposite end portions in the arrangement direction of the attracted members 17. The positioning notches 31*a* have a size corresponding to the positioning parts 13 of the connector body 11 in the same manner as the positioning notches 14*a* at the base member 14 of the connection object C2.

Figure 20:
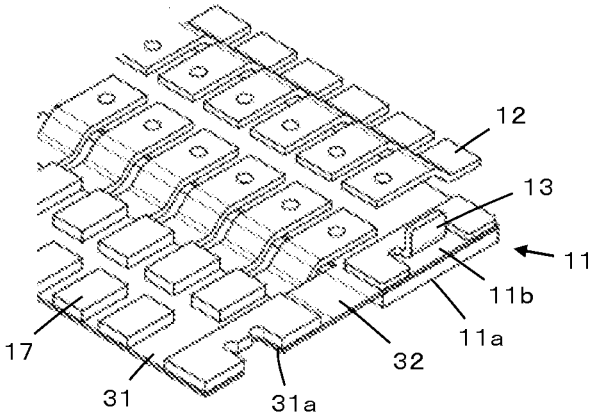
FIG. 20 is an enlarged perspective view showing the main part of the magnetic connector of Embodiment 3.

As shown in FIG. 20, the support member 31 and the connecting parts 32 may be formed integrally with the insulation sheet 11*b* stuck to the surface of the magnet 11*a* of the connector body 11. For example, a component in which the insulation sheet 11*b* and the support member 31 are interconnected via a pair of the connecting parts 32 may be formed for use by cutting a single polyimide sheet.

The connector body 11 and the connection terminals 12 are the same as those used in Embodiment 2 except that a pair of the connecting parts 32 are connected to the connector body 11, and the positioning parts 13 are formed on the surface of the connector body 11 separately at opposite end portions in the arrangement direction of the connection terminals 12. The base member 14 of the connection object C2 is also the same as that used in Embodiment 2. The contact patterns 16 are formed on the bottom surface of the base member 14, and the positioning notches 14*a* are separately formed at edges of the base member 14 at opposite end portions in the arrangement direction of the contact patterns 16.

Figure 21:
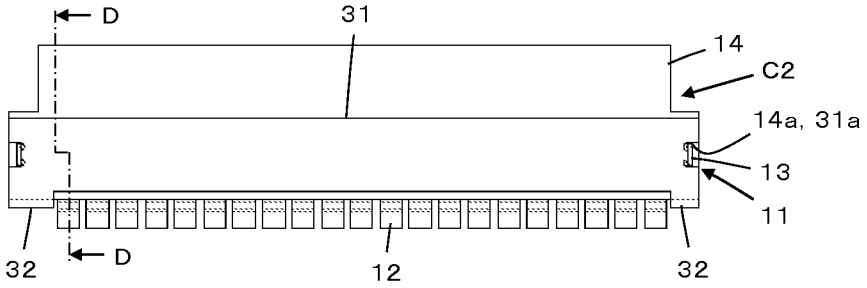
FIG. 21 is a plan view showing the magnetic connector of Embodiment 3 in fitting state.

The connection object C2 can be fitted to the connector body 11 by positioning the connection object C2 over the connector body 11 as engaging a pair of the positioning notches 14*a* formed at the base member 14 of the connection object C2 with the corresponding positioning parts 13 of the connector body 11 with the open position being established in which the support member 31 is positioned laterally to the connector body 11 as shown in FIGS. 17 and 18 and subsequently, bringing the support member 31 to the close position to thereby cause the connection object C2 to be sandwiched between the connector body 11 and the support member 31 so that a pair of the positioning notches 31*a* formed at the support member 31 are engaged with the corresponding positioning parts 13 of the connector body 11 as shown in FIGS. 19 and 21.

Figure 22:
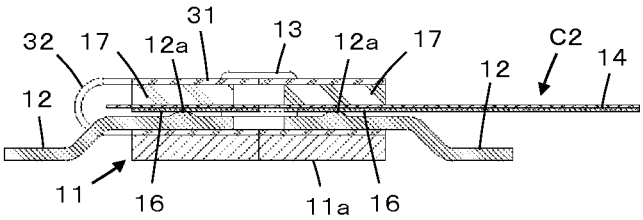
FIG. 22 is a cross-sectional view taken along line D-D of FIG. 21.

Insertion of the positioning parts 13 of the connector body 11 into the positioning notches 14*a* of the connection object C2 and the positioning notches 31*a* of the support member 31 enables the connection object C2 and the support member 31 to be properly positioned with respect to the connector body 11. As a result, the contact portions 12*a* of the connection terminals 12 and the corresponding contact patterns 16 of the connection object C2 vertically overlap each other, and the attracted members 17 fixed on the support member 31 are positioned to vertically overlap the contact portions 12*a* of the corresponding connection terminals 12 and the corresponding contact patterns 16 of the connection object C2 via the base member 14 of the connection object C2 as shown in FIG. 22.

The magnetic force from the magnet 11*a* of the connector body 11 acts on the attracted members 17 formed of magnetic substance, so that the respective attracted members 17 are attracted toward the connector body 11, and the contact patterns 16 of the connection object C2 located immediately below the corresponding attracted members 17 are pressed against the contact portions 12*a* of the corresponding connection terminals 12. Uniform contact pressure is therefore ensured between the connection terminals 12 and the contact patterns 16 of the connection object C2, thus achieving highly reliable connection.

In Embodiment 3, the support member 31 retaining the attracted members 17 is connected to the connector body 11 via a pair of the connecting parts 32, which allows the connection of the connection object C2 that already exists to be achieved with excellent operability.

Embodiment 4

Figure 23:
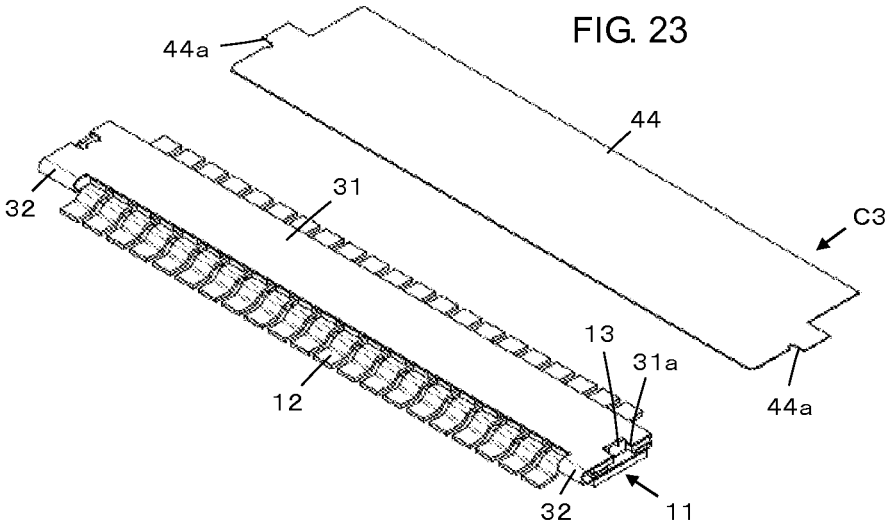
FIG. 23 is a perspective view showing a magnetic connector according to Embodiment 4 when viewed obliquely from above.
Figure 24:
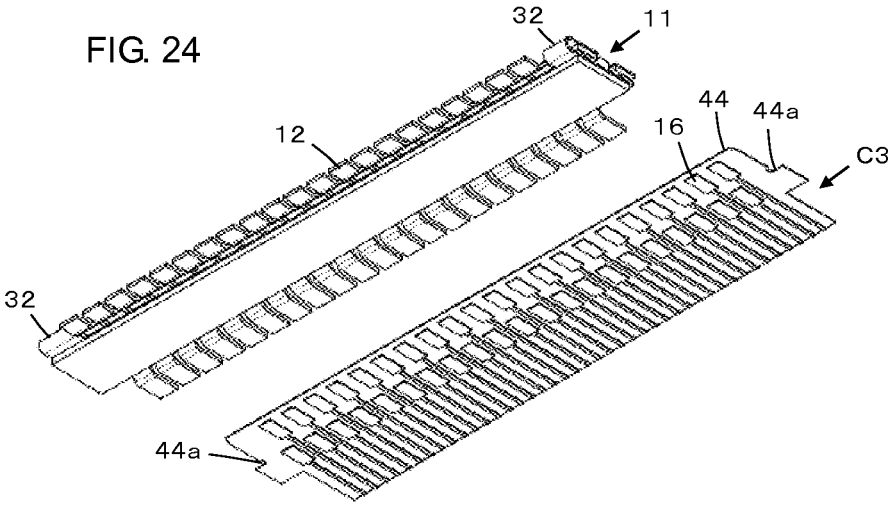
FIG. 24 is a perspective view showing the magnetic connector according to Embodiment 4 when viewed obliquely from the bottom.

FIGS. 23 and 24 show the structure of a magnetic connector according to Embodiment 4. This magnetic connector is the same as that in Embodiment 3 shown in FIGS. 17 and 18 except that the support member 31 is brought to the close position where the connection object C2 is not sandwiched and the attracted members 17 are attracted and attached to the connector body 11, and under this condition, a connection object C3 is inserted from the side between the attracted members 17 and the connection terminals 12 to thereby establish the connection of the connection object C3.

In the connection object C3, the contact patterns 16 are arranged in two lines on the bottom surface of a base member 44 having a sheet-like shape and flexibility as with the connection object C2 used in Embodiment 3. However, while the base member 14 of the connection object C2 has the positioning notches 14*a* of U-shape at opposite end portions in the arrangement direction of the contact patterns 16 for receiving the positioning parts 13 of the connector body 11, the base member 44 of the connection object C3 has positioning notches 44*a* of uneven shape, which allows the positioning notches 44*a* to abut the positioning parts 13 of the connector body 11, at opposite end portions in the arrangement direction of the contact patterns 16.

Figure 25:
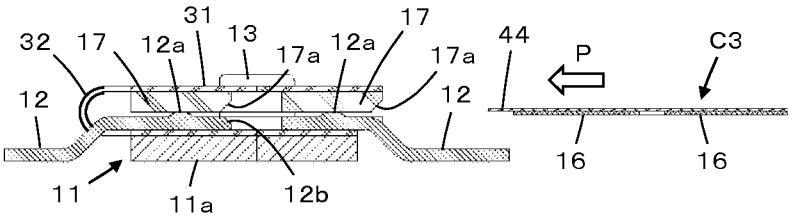
FIG. 25 is a cross-sectional view showing the magnetic connector of Embodiment 4 before fitting state is established.

When the connection object C3 is not in fitting state, as shown in FIG. 25, the support member 31 overlaps the connector body 11 as a pair of the positioning notches 31*a* formed at the support member 31 are engaged with the corresponding positioning parts 13 of the connector body 11, and the attracted members 17 fixed on the support member 31 are attracted toward the connector body 11 owing to the magnetic force from the magnet 11*a* of the connector body 11 and thereby pressed against the contact portions 12*a* of the corresponding contact terminals 12.

Figure 26:
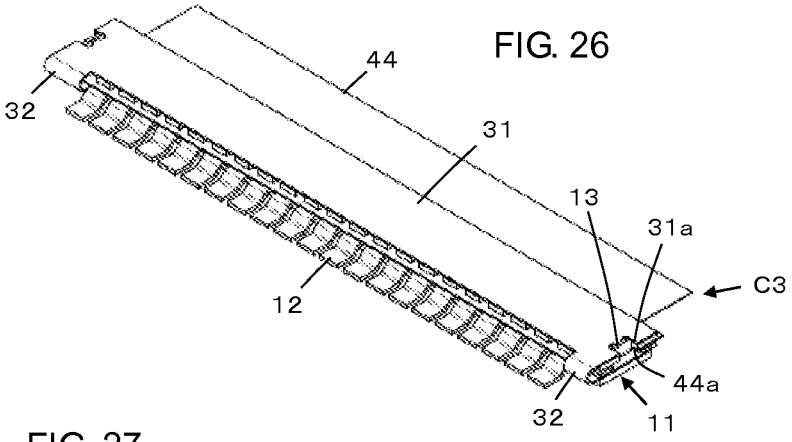
FIG. 26 is a perspective view showing the magnetic connector of Embodiment 4 in fitting state.
Figure 27:
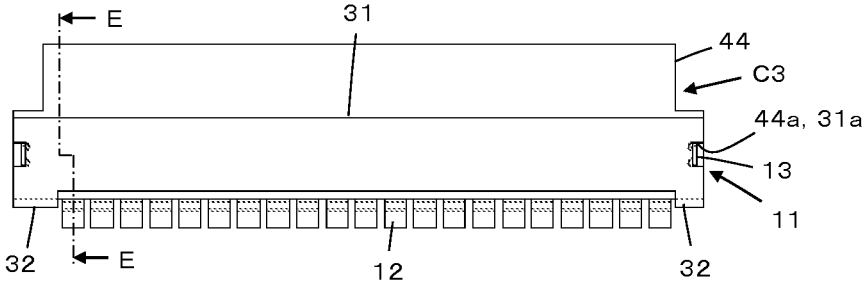
FIG. 27 is a plan view showing the magnetic connector of Embodiment 4 in fitting state.

In this state, as indicated by arrow P in FIG. 25, the connection object C3 is slid between the attracted members 17 and the connection terminals 12 from the side and inserted until the positioning notches 44*a* of the base member 44 abut the positioning parts 13 of the connector body 11, whereby the connection object C3 is fitted to the connector body 11 as shown in FIGS. 26 and 27.

Insertion of the positioning parts 13 of the connector body 11 into the positioning notches 31*a* of the support member 31 and abutment of the positioning notches 44*a* of the base member 44 of the connection object C3 to the positioning parts 13 of the connector body 11 enable the connection object C3 and the support member 31 to be properly positioned with respect to the connector body 11. As a result, the contact portions 12*a* of the connection terminals 12, the corresponding contact patterns 16 of the connection object C3, and the corresponding attracted members 17 fixed on the support member 31 are positioned to vertically overlap each other as shown in FIG. 28.

The magnetic force from the magnet 11*a* of the connector body 11 acts on the attracted members 17 formed of magnetic substance, so that the respective attracted members 17 are attracted toward the connector body 11, and the contact patterns 16 of the connection object C3 located immediately below the corresponding attracted members 17 are pressed against the contact portions 12*a* of the corresponding connection terminals 12. Uniform contact pressure is therefore ensured between the connection terminals 12 and the contact patterns 16 of the connection object C3, thus achieving highly reliable connection.

Figure 28:
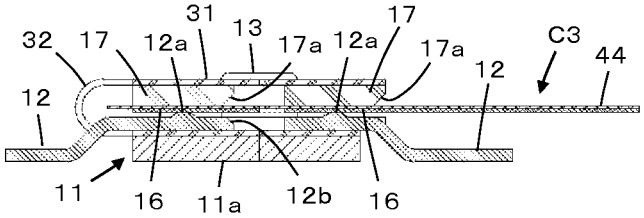
FIG. 28 is a cross-sectional view taken along line E-E of FIG. 27.

As shown in FIGS. 25 and 28, an insertion guide 17*a* composed of an inclined surface or a curved surface for guiding the insertion of the connection object C3 is preferably formed at an end of each attracted member 17 on the side from which the connection object C3 is inserted.

Similarly, an insertion guide 12*b* composed of an inclined surface or a curved surface for guiding the insertion of the connection object C3 is preferably formed at an end of each connection terminal 12 on the side from which the connection object C3 is inserted.

The insertion guides 17*a* and 12*b* enable the connection object C3 to be smoothly slid and inserted between the attracted members 17 and the connection terminals 12 even when the attracted members 17 are pressed against the contact portions 12*a* of the corresponding connection terminals 12 due to the magnetic force.

In Embodiment 4, the connection of the connection object C3 can be established only with slide operation of the connection object C3 and the operability is therefore improved. In particular, when the connection of the connection object C3 is automated, this configuration is extremely useful.

Furthermore, the connection object C3 is inserted between the attracted members 17 and the connection terminals 12 with the attracted members 17 being pressed against the contact portions 12*a* of the corresponding connection terminals 12 due to the magnetic force, and at this time, so-called wiping action occurs between the contact patterns 16 of the connection object C3 and the contact portions 12*a* of the corresponding connection terminals 12. This can mitigate the influence of dust and coatings formed on surfaces of the contact patterns 16 and contact portions 12*a*, thus further improving connection reliability.

Embodiment 5

Figure 29:
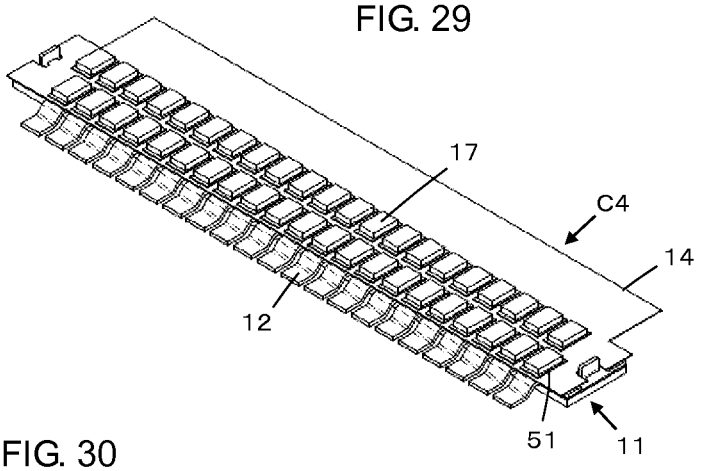
FIG. 29 is a perspective view showing the magnetic connector of Embodiment 5 in fitting state.
Figure 30:
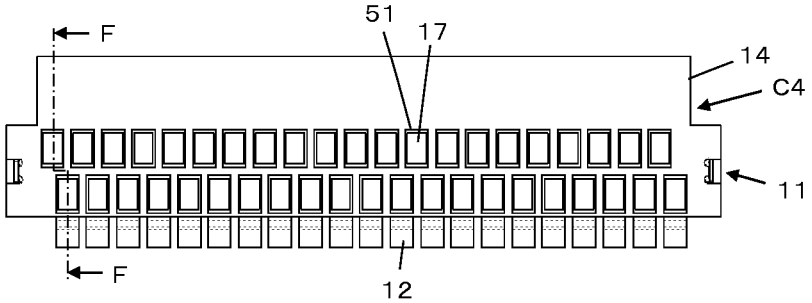
FIG. 30 is a plan view showing the magnetic connector of Embodiment 5 in fitting state.

FIGS. 29 and 30 show the structure of a magnetic connector according to Embodiment 5. In this magnetic connector, a connection object C4 is used instead of the connection object C1 in the magnetic connector of Embodiment 1 shown in FIGS. 1 and 2. While in Embodiment 1, the attracted members 17 are directly joined or adhered to the top surface of the base member 14 of the connection object C1 by thermocompression or adhesion, the connection object C4 used in Embodiment 5 has formed in advance on its top surface a plurality of fixing pads 51, and the attracted members 17 are respectively fixed on surfaces of the fixing pads 51 by soldering.

Figure 31:
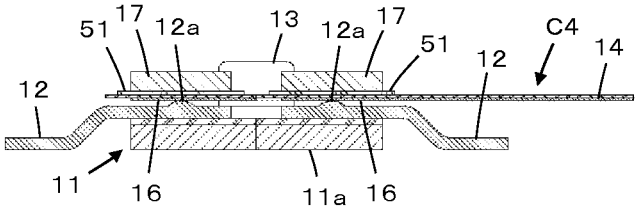
FIG. 31 is a cross-sectional view taken along line F-F of FIG. 30.

Also with such a configuration, the magnetic force from the magnet 11*a* of the connector body 11 acts on the attracted members 17 formed of magnetic substance, so that the respective attracted members 17 are attracted toward the connector body 11, and the contact patterns 16 of the connection object C4 located immediately below the corresponding attracted members 17 are pressed against the contact portions 12*a* of the corresponding connection terminals 12 as shown in FIG. 31. Uniform contact pressure is therefore ensured between the connection terminals 12 and the contact patterns 16 of the connection object C4, thus achieving highly reliable connection.

Embodiment 6

Figure 32:
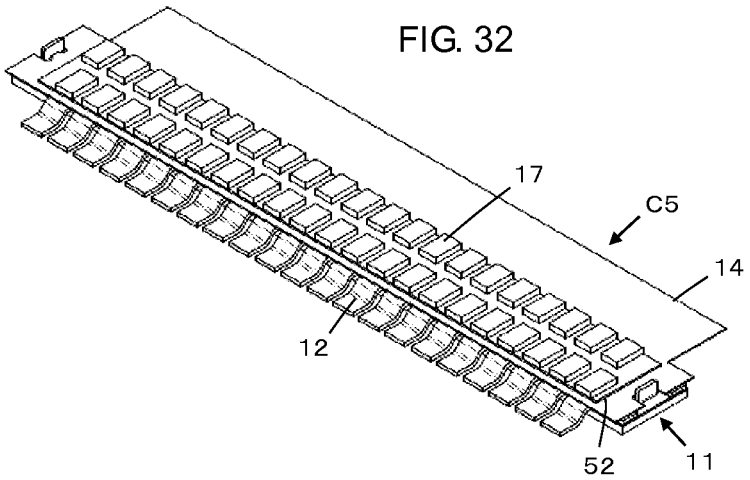
FIG. 32 is a perspective view showing the magnetic connector of Embodiment 6 in fitting state.
Figure 33:
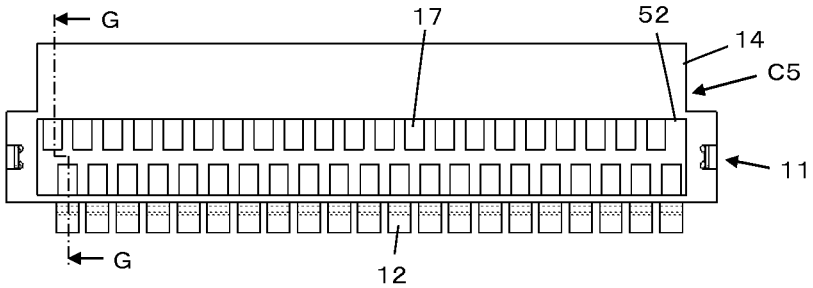
FIG. 33 is a plan view showing the magnetic connector of Embodiment 6 in fitting state.

FIGS. 32 and 33 show the structure of a magnetic connector according to Embodiment 6. In this magnetic connector, a connection object C5 is used instead of the connection object C1 in the magnetic connector of Embodiment 1 shown in FIGS. 1 and 2. While in Embodiment 1, the attracted members 17 are directly joined or adhered to the top surface of the base member 14 of the connection object C1 by thermocompression or adhesion, for the connection object C5 used in Embodiment 6, a fixing sheet 52 having flexibility is prepared, the attracted members 17 are fixed on the top surface of the fixing sheet 52 in advance, and the fixing sheet 52 having the attracted members 17 fixed thereon is attached to the top surface of the base member 14.

Figure 34:
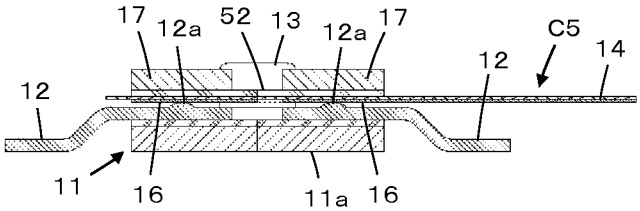
FIG. 34 is a cross-sectional view taken along line G-G of FIG. 33.

Also with such a configuration, the magnetic force from the magnet 11*a* of the connector body 11 acts on the attracted members 17 formed of magnetic substance, so that the respective attracted members 17 are attracted toward the connector body 11, and the contact patterns 16 of the connection object C5 located immediately below the corresponding attracted members 17 are pressed against the contact portions 12*a* of the corresponding connection terminals 12 as shown in FIG. 34. Uniform contact pressure is therefore ensured between the connection terminals 12 and the contact patterns 16 of the connection object C5, thus achieving highly reliable connection.

Furthermore, in Embodiment 6, the fixing sheet 52 on which the attracted members 17 are fixed in advance is attached to the top surface of the base member 14 for use and therefore, the magnetic connector of this embodiment can establish the connection of an existing connection object comprising an FPC or the like only by attaching the fixing sheet 52 having the attracted members 17 fixed thereon to the connection object.

Embodiment 7

Figure 35:
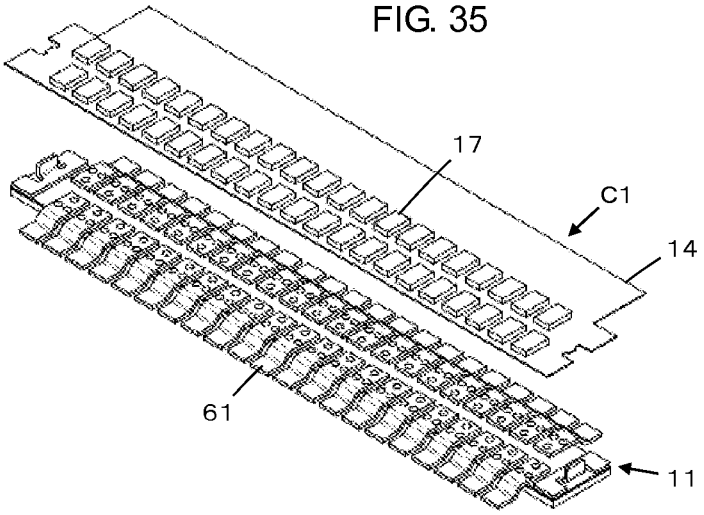
FIG. 35 is a perspective view showing a magnetic connector according to Embodiment 7.

FIG. 35 shows the structure of a magnetic connector according to Embodiment 7. This magnetic connector is the same as that in Embodiment 1 shown in FIGS. 1 and 2 except that instead of the connection terminals 12, a plurality of connection terminals 61 are arranged and fixed on the connector body 11.

Figure 36:
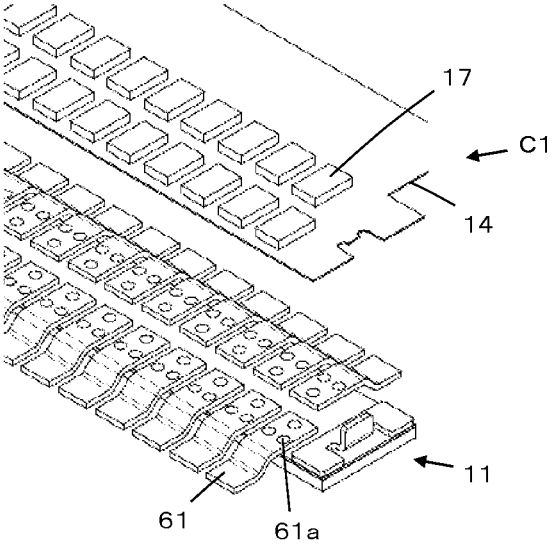
FIG. 36 is an enlarged perspective view partially showing the magnetic connector of Embodiment 7.

While each of the connection terminals 12 used in Embodiment 1 has on its surface a single contact portion 12*a*, each of the connection terminals 61 used in Embodiment 7 has on its surface three contact portions 61*a* that protrude and are positioned not to be aligned in a single straight line as shown in FIG. 36.

Owing to the three contact portions 61*a* that protrude from the surface of each connection terminal 61, when the respective attracted members 17 are attracted toward the connector body 11 due to the magnetic force from the magnet 11*c* of the connector body 11 and the contact patterns 16 of the connection object C1 are pressed against the contact portions 61*a* of the corresponding connection terminals 61, three contact portions 61*a* serve to stabilize the attitude of the corresponding attracted member 17 and contact pattern 16, thus improving connection reliability.

It should be noted that not three but two or four or more contact portions 61*a* may be formed at each connection terminal 61. However, it is preferable to form three contact portions 61*a* in terms of the stability of attitude of the corresponding contact pattern 16.

Also in Embodiments 2 to 6 described above, the connection terminals 61 each having plural contact portions 61*a* may be employed in place of the connection terminals 12.

Embodiment 8

While in Embodiment 1, the attracted members 17 and the connection terminals 12 correspond to each other on a one-to-one basis, the invention is not limited thereto and may be configured so that a single attracted member corresponds to two or more connection terminals.

Figure 37:
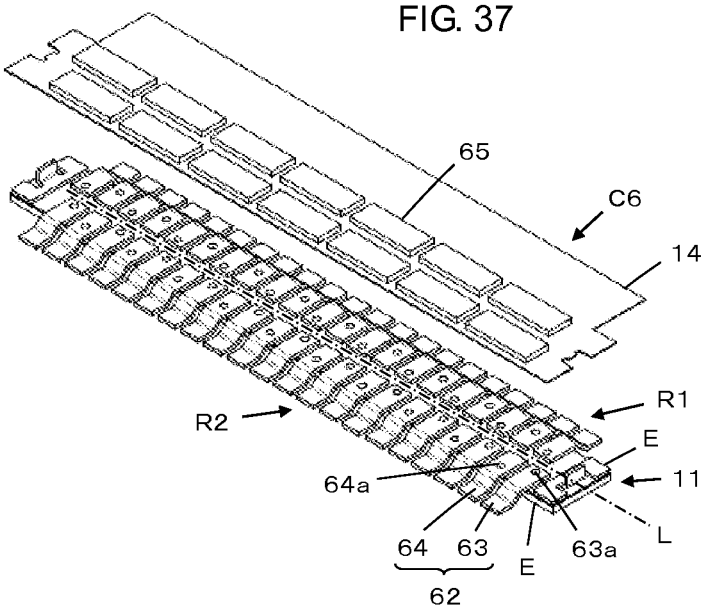
FIG. 37 is a perspective view showing a magnetic connector according to Embodiment 8.

For instance, in a magnetic connector shown in FIG. 37, each attracted member 65 corresponds to three connection terminals 62.

The connector body 11 has fixed thereon a plurality of the connection terminals 62 arranged in two lines consisting of rows R1 and R2. The connection terminals 62 include first connection terminals 63 whose contact portions 63*a* are formed in the vicinity of a center line L of the connector body 11 and second connection terminals 64 whose contact portions 64*a* are formed in the vicinity of an edge E parallel to the center line L of the connector body 11, and are arranged so that the first connection terminals 63 and the second connection terminals 64 are alternately placed in each of the rows R1 and R2.

Figure 38:
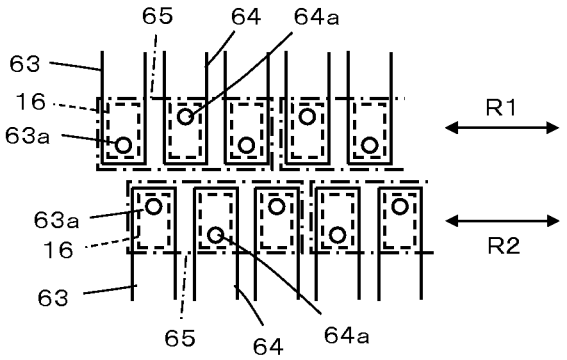
FIG. 38 is a plan view showing the positional relation among connection terminals, contact patterns and attracted members in the magnetic connector according to Embodiment 8.

On the other hand, although not shown in FIG. 37, the contact patterns 16 are arranged in two lines on the bottom surface of the base member 14 of a connection object C6 on a one-to-one basis with respect to the connection terminals 62, and a plurality of the attracted members 65 formed of magnetic substance (ferromagnetic substance) are fixed on the top surface of the base member 14. The attracted members 65, which are arranged in two lines to correspond to the connection terminals 62, have a length covering three contact patterns 16, i.e., three connection terminals 62 arranged in a line as shown in FIG. 38.

Also with such a configuration, the magnetic force from the connector body 11 acts on the attracted members 65 formed of magnetic substance, so that the respective attracted members 65 are attracted toward the connector body 11, and every three contact patterns 16 of the connection object C6 located immediately below the corresponding attracted member 65 are pressed against the corresponding connection terminals 62. Uniform contact pressure is therefore ensured between the connection terminals 62 and the contact patterns 16 of the connection object C6, thus achieving highly reliable connection.

Furthermore, since the first connection terminals 63 and the second connection terminals 64 are alternately placed in each of the rows R1 and R2, three connection terminals 62 covered by one attracted member 65 consist of a combination of two first connection terminals 63 and one second connection terminal 64 or a combination of one first connection terminal 63 and two second connection terminals 64. Consequently, three contact portions that consist of a combination of two contact portions 63*a* and one contact portion 64*a* or a combination of one contact portion 63*a* and two contact portions 64*a* and that protrude at positions not aligned in a single straight line are positioned immediately below each of the attracted members 65. As a result, when the respective attracted members 65 are attracted toward the connector body 11 due to the magnetic force from the connector body 11 and every three contact patterns 16 of the connection object C6 located immediately below the corresponding attracted member 65 are pressed against the corresponding connection terminals 62, three contact portions 61*a* serve to stabilize the attitude of the corresponding attracted member 65, and this leads to stable attitude of the corresponding three contact patterns 16 located immediately below the attracted member 65, thus improving connection reliability.

Figure 39:
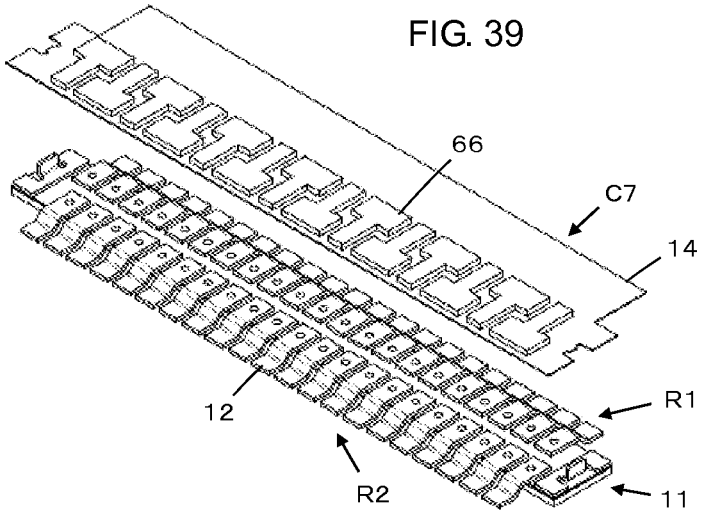
FIG. 39 is a perspective view showing a magnetic connector according to a modification of Embodiment 8.

Alternatively, in a magnetic connector shown in FIG. 39, each attracted member 66 also corresponds to three connection terminals 12.

The connection terminals 12 which are the same as those used in Embodiment 1 are arranged and fixed in two lines consisting of rows R1 and R2 on the connector body 11.

Figure 40:
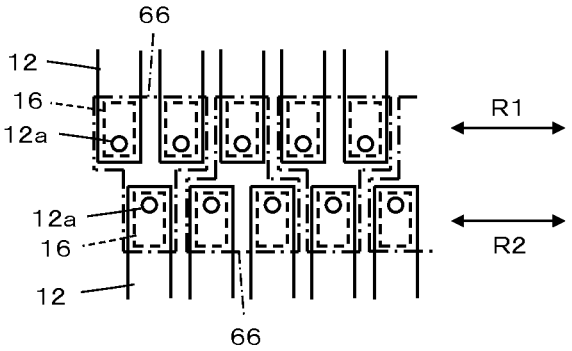
FIG. 40 is a plan view showing the positional relation among connection terminals, contact patterns and attracted members in the magnetic connector according to the modification of Embodiment 8.

Although not shown in FIG. 39, the contact patterns 16 are arranged in two lines on the bottom surface of the base member 14 of a connection object C7 on a one-to-one basis with respect to the connection terminals 12, and a plurality of the attracted members 66 formed of magnetic substance (ferromagnetic substance) are fixed on the top surface of the base member 14. Each of the attracted members 66 has a flat T-shape and is formed to cover three connection terminals consisting of a combination of two connection terminals 12 adjacent to each other in the row R1 and one connection terminal 12 in the row R2 or a combination of one connection terminal 12 in the row R1 and two connection terminals 12 adjacent to each other in the row R2 as shown in FIG. 40. The attracted members 66 configured as above are arranged in a line with their facing directions being alternately reversed by 180 degrees.

Also with such a configuration, the magnetic force from the connector body 11 acts on the attracted members 66 formed of magnetic substance, so that the respective attracted members 66 are attracted toward the connector body 11, and every three contact patterns 16 of the connection object C7 located immediately below the corresponding attracted member 66 are pressed against the corresponding connection terminals 12. Uniform contact pressure is therefore ensured between the connection terminals 12 and the contact patterns 16 of the connection object C7, thus achieving highly reliable connection.

In addition, since the attracted members 66 each correspond to two connection terminals 12 in one of the rows R1 and R2 and one connection terminal 12 in the other of the rows R1 and R2, three contact portions 12*a* that protrude at positions not aligned in a single straight line are located immediately below each attracted member 66. As a result, when the respective attracted members 66 are attracted toward the connector body 11 due to the magnetic force from the connector body 11 and every three contact patterns 16 of the connection object C7 located immediately below the corresponding attracted member 66 are pressed against the corresponding connection terminals 12, three contact portions 12*a* serve to stabilize the attitude of the corresponding attracted member 66, and this leads to stable attitude of the corresponding three contact patterns 16 located immediately below the attracted member 66, thus improving connection reliability.

In the same manner, Embodiments 2 to 7 described above may also be configured so that a single attracted member correspond to two or more connection terminals.

Embodiment 9

Figure 41:
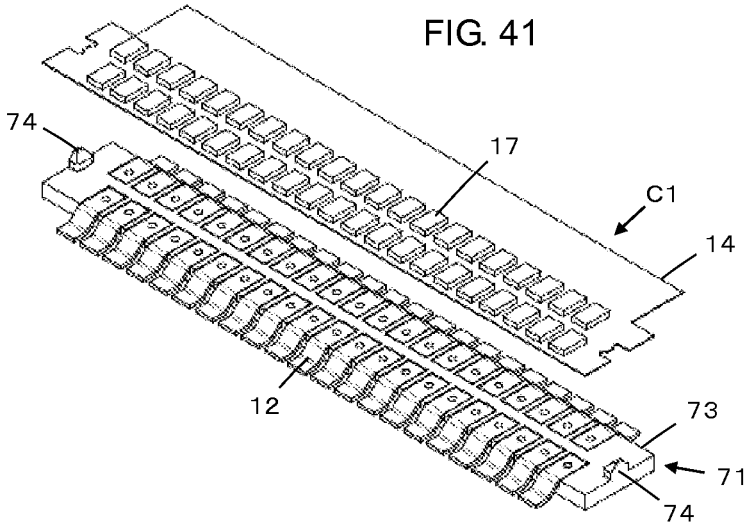
FIG. 41 is a perspective view showing a magnetic connector according to Embodiment 9 when viewed obliquely from above.
Figure 42:
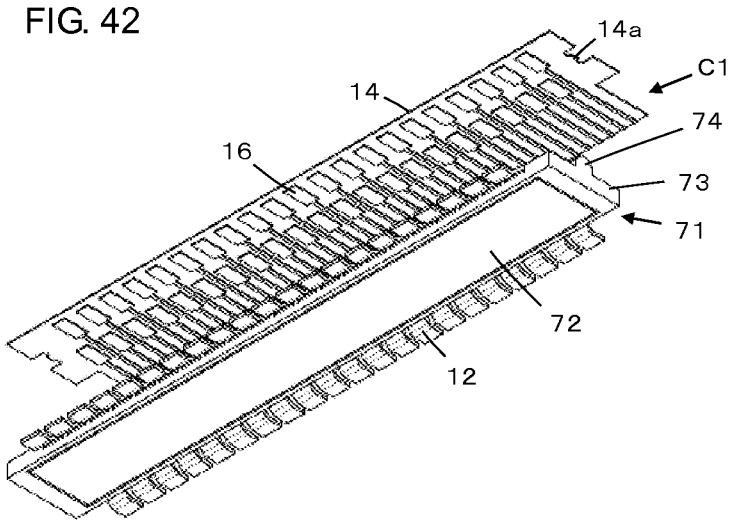
FIG. 42 is a perspective view showing the magnetic connector according to Embodiment 9 when viewed obliquely from the bottom.

FIGS. 41 and 42 show the structure of a magnetic connector according to Embodiment 9. This magnetic connector is the same as that in Embodiment 1 shown in FIGS. 1 and 2 except that a connector body 71 is used instead of the connector body 11 and a plurality of connection terminals 12 are arranged and fixed on the connector body 71.

The connector body 71 has a magnet 72 of flat plate shape and a housing 73 made of insulating resin that covers the upper portion of the magnet 72. Positioning parts 74 each composed of a projection and used for positioning the connection object C1 are formed integrally on the surface of the housing 73 of the connector body 71 separately at opposite end portions in the arrangement direction of the connection terminals 12.

Figure 43:
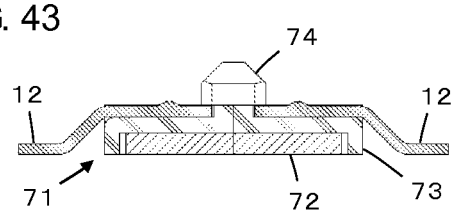
FIG. 43 is a cross-sectional view showing a connector body of the magnetic connector according to Embodiment 9.

The housing 73 is made of insulating resin and this allows the connection terminals 12 to be directly disposed on the surface of the housing 73 without an insulation sheet as shown in FIG. 43.

Thus, the use of the connector body 71 in which the housing 73 covers the upper portion of the magnet 72 also enables highly reliable connection to be established in the same manner as in Embodiment 1.

Embodiment 10

Figure 44:
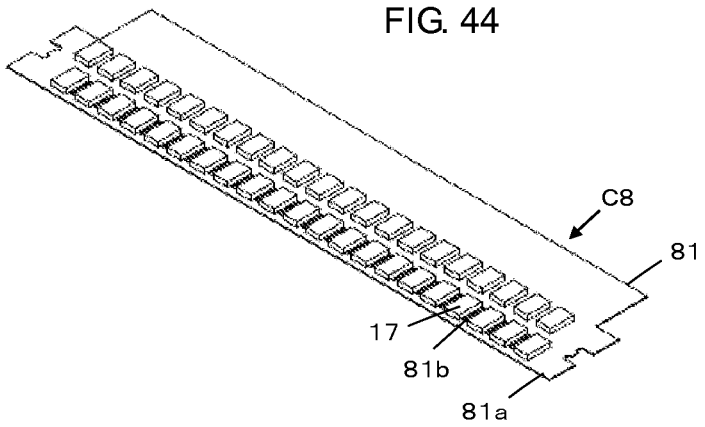
FIG. 44 is a perspective view showing a connection object used with a magnetic connector according to Embodiment 10 when viewed obliquely from above.
Figure 45:
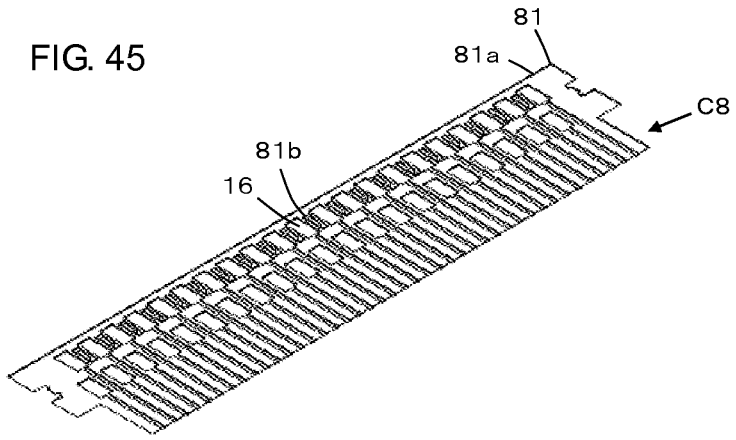
FIG. 45 is a perspective view showing the connection object used with the magnetic connector according to Embodiment 10 when viewed obliquely from the bottom.
Figure 46:
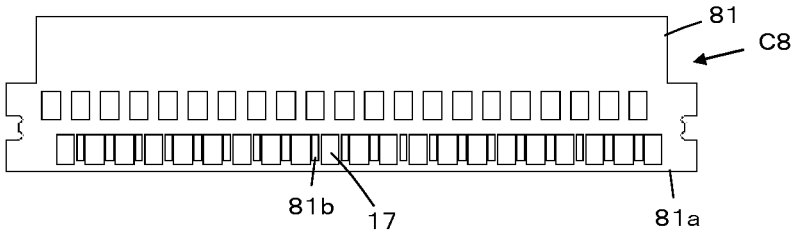
FIG. 46 is a plan view showing the connection object used with the magnetic connector according to Embodiment 10.

FIGS. 44 to 46 show the structure of a connection object C8 used in a magnetic connector according to Embodiment 10. The connection object C8 is the same as the connection object C1 in Embodiment 1 except that a base member 81 is used instead of the base member 14. The base member 81 is a sheet-like member having flexibility and made of, for instance, polyimide. The contact patterns 16 are arranged in two lines on the bottom surface of the base member 81 while the attracted members 17 formed of magnetic substance (ferromagnetic substance) are arranged and fixed in two lines on the top surface of the base member 81 on a one-to-one basis with respect to the contact patterns 16. Openings 81*b* are each formed between every two adjacent contact patterns 16 of one line arranged along a connection end 81*a* of the base member 81, i.e., between every two adjacent attracted members 17 of one line arranged along the connection end 81*a*.

Owing to a plurality of the openings 81*b* that are each formed between every two adjacent contact patterns 16, the flexibility of the base member 81 increases in the vicinity of the openings 81*b*. This allows the base member 81 to reduce its restraint when the connection object C8 is fitted, so that the attracted members 17 are individually attracted to the connector body 11 and the contact patterns 16 are individually pressed against the contact portions 12*a* of the corresponding connection terminals 12, thus improving connection reliability.

Figure 47:
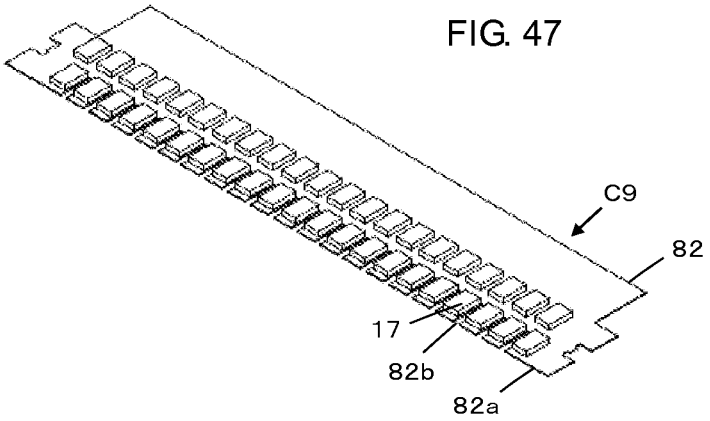
FIG. 47 is a perspective view showing a connection object used with a magnetic connector according to a modification of Embodiment 10 when viewed obliquely from above.
Figure 48:
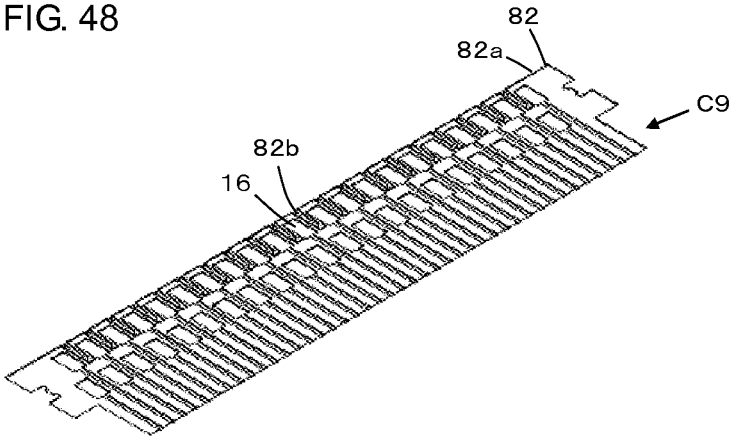
FIG. 48 is a perspective view showing the connection object used with the magnetic connector according to the modification of Embodiment 10 when viewed obliquely from the bottom.
Figure 49:
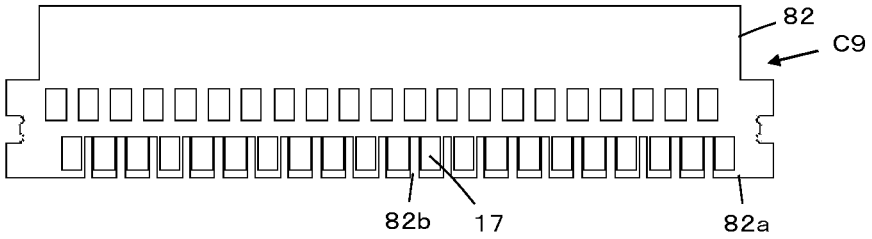
FIG. 49 is a plan view showing the connection object used with the magnetic connector according to the modification of Embodiment 10.
Figure 50:
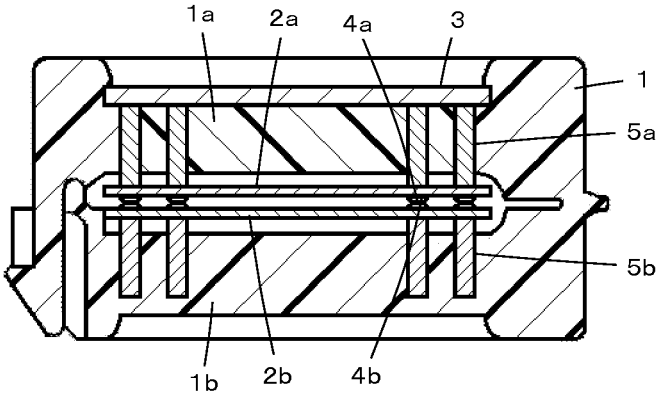
FIG. 50 PRIOR ART
FIG. 50 is a cross-sectional view showing the structure of a conventional magnetic connector.

FIGS. 47 to 49 show the structure of a connection object C9 used in a magnetic connector according to a modification of Embodiment 10. The connection object C9 includes a base member 82 having a sheet-like shape and flexibility, and the contact patterns 16 are arranged on the bottom surface of the base member 82 while the attracted members 17 are arranged on the top surface of the base member 82 in the same manner as the connection object C8 shown in FIGS. 44 to 46. However, the base member 82 has a plurality of slits 82*b* each formed between every two adjacent contact patterns 16 of one line arranged along a connection end 82*a*, i.e., between every two adjacent attracted members 17 of one line arranged along the connection end 82*a*.

The slits 82*b* each formed between every two adjacent contact patterns 16 also serve to increase the flexibility of the base member 82 in the vicinity of the slits 82*b*. This allows the base member 82 to reduce its restraint when the connection object C9 is fitted, so that the attracted members 17 are individually attracted to the connector body 11 and the contact patterns 16 are individually pressed against the contact portions 12*a* of the corresponding connection terminals 12, thus improving connection reliability.

While in Embodiments 1 to 10 described above, a flexible printed circuit (FPC) is used as each of the connection objects C1 to C9, the present invention enables the connection of any sheet-like connection object, such as a flexible flat cable (FFC), in which a plurality of contact patterns are arranged on a flexible base member to be established.

What is claimed is:

1. A magnetic connector for use in establishing connection of a connection object in which a plurality of contact patterns are arranged in an arrangement direction on a base member having flexibility, comprising:

a connector body including a magnet of flat plate shape which has a side edge extending in the arrangement direction;

a plurality of connection terminals that are arranged along the side edge of the magnet and fixed on the connector body so as to correspond to the plurality of contact patterns of the connection object; and a plurality of attracted members that are formed of magnetic substance, are arranged and fixed on the base member of the connection object and are, via the connection object on which the plurality of contact patterns are arranged to face the plurality of connection terminals, attracted toward the connector body due to magnetic force whereby the plurality of contact patterns are pressed against the plurality of connection terminals and thereby connected to the plurality of connection terminals;

wherein each of the plurality of connection terminals has a step as it crosses the side edge of the magnet so as to extend along the side edge of the magnet.

2. The magnetic connector according to claim 1, wherein the plurality of attracted members are fixed on, of a pair of surfaces of the base member of the connection object, one surface opposite from another surface on which the plurality of contact patterns are formed; and wherein the plurality of contact patterns are connected to the plurality of connection terminals by disposing the connection object on the connector body as positioning the plurality of contact patterns and the plurality of connection terminals with respect to each other.

3. The magnetic connector according to claim 2, wherein the plurality of attracted members are directly fixed on a surface of the base member of the connection object.

4. The magnetic connector according to claim 2, wherein the plurality of attracted members are respectively fixed by soldering on a plurality of fixing pads formed on a surface of the base member of the connection object.

5. The magnetic connector according to claim 2, wherein the plurality of attracted members are fixed on a fixing sheet having flexibility and the fixing sheet is attached to a surface of the base member of the connection object.

6. The magnetic connector according to claim 1, further comprising a positioning part used to position the connection object with respect to the connector body.

7. The magnetic connector according to claim 6, wherein the base member of the connection object has a positioning notch; and wherein the positioning part is composed of a projection to be inserted into the positioning notch of the connection object.

8. The magnetic connector according to claim 7, wherein the projection is formed of a metal member fixed on a surface of the connector body.

9. The magnetic connector according to claim 7, wherein the connector body has a housing configured to cover the magnet;

wherein the plurality of connection terminals are fixed on a surface of the housing; and wherein the projection is formed integrally with the housing.

10. The magnetic connector according to claim 1, wherein the plurality of attracted members and the plurality of connection terminals correspond to each other on a one-to-one basis.

11. The magnetic connector according to claim 1, wherein the plurality of connection terminals and the plurality of attracted member are arranged such that one attracted member corresponds to two or more connection terminals.

12. The magnetic connector according to claim 1, wherein a plurality of contact portions protrude from each of the plurality of connection terminals.

13. The magnetic connector according to claim 1, wherein the base member of the connection object has a plurality of openings or slits each formed between adjacent two of the plurality of contact patterns.

* * * * *